US008541702B2

(12) United States Patent
Blalock

(10) Patent No.: US 8,541,702 B2
(45) Date of Patent: Sep. 24, 2013

(54) FOLDING HIGH VOLTAGE ELECTRIC POWER SWITCH

(75) Inventor: Frank Clay Blalock, Hampton, GA (US)

(73) Assignee: Southern States, LLC, Hampton, GA (US)

( * ) Notice: Subject to any disclaimer, the term of this patent is extended or adjusted under 35 U.S.C. 154(b) by 278 days.

(21) Appl. No.: 13/206,569

(22) Filed: Aug. 10, 2011

(65) Prior Publication Data

US 2013/0037399 A1 Feb. 14, 2013

(51) Int. Cl.
*H01H 31/02* (2006.01)

(52) U.S. Cl.
USPC ..... 200/48 R

(58) Field of Classification Search
USPC ..... 200/48 R, 48 P, 48 A, 49, 61.58 R, 200/61.85, 50.01, 50.02, 50.11
See application file for complete search history.

(56) References Cited

U.S. PATENT DOCUMENTS

| | | | | |
|---|---|---|---|---|
| 4,049,936 | A * | 9/1977 | Frink et al. | 218/12 |
| 4,072,999 | A * | 2/1978 | Volman et al. | 361/602 |
| 4,107,486 | A * | 8/1978 | Evans | 200/48 R |
| 4,136,372 | A * | 1/1979 | Oak | 361/131 |

* cited by examiner

*Primary Examiner* — Edwin A. Leon
(74) *Attorney, Agent, or Firm* — Michael J. Mehrman; Mehrman Law Office

(57) ABSTRACT

A folding high voltage electric power switch that can be fully assembled, tested and adjusted at the factory and then folded for shipping on a road truck with minimal disassembly. The switch can then be readied for installation with minimal field assembly largely limited to unfolding and securing support beams and struts. The switch includes a number of phase insulators (i.e., two phase insulators for a 2-way switch and three phase insulators for a three-way switch), a central switch insulator and a number of blade arms, each selectively connecting an electric power tap at the central insulator to an electric power tap at a respective phase insulator. The platform includes structural beams and struts that easily fold for transportation and unfold for installation in the field while the beams, struts, insulators and blade arms remain attached together.

18 Claims, 7 Drawing Sheets

FOLDING HIGH VOLTAGE ELECTRIC POWER SWITCH

TECHNICAL FIELD

The present invention relates to electric switchgear and, more particularly, relates to folding high voltage electric power switch that allows assembly, testing and adjustment of all major components at the factory, folding of the switch for transportation, and minimal assembly in the field largely limited to folding out and securing supports beams and struts with a small number of bolts.

BACKGROUND OF THE INVENTION

High voltage electric power line switches are used for a variety of purposes, such as interrupting current to loads and other circuit devices. Higher voltage switches are physically larger than lower voltage switches due to the required insulating distances. While switches generally rated for sub-transmission voltages (e.g., approximately 25 kV and below) are physically small enough to be assembled at a factory and transported on a road truck fully assembled, higher voltage transmission switches (e.g., above 25 kV) are generally too large to be transported on a road truck when fully assembled. As a result, higher voltage transmission switches are conventionally shipped as disassembled components, which have to be assembled, adjusted and tested in the field at the line installation site. Of course, field locations are generally outdoors while the factory provides a convenient indoor assembly and testing location. As electric power lines run in all types of terrain, assembly, adjustment and testing of the switch in the field can be difficult. Although assembly, adjustment and testing in the factory would be preferable, this approach has not been available for higher voltage transmission switches.

There is, therefore, a continuing need for improved assembly, adjustment and testing techniques for high voltage transmission switches that minimize field assembly while still allowing the switches to be transported by road truck.

SUMMARY OF THE INVENTION

The present invention meets the needs described above in a folding high voltage electric power switch that can be fully assembled, adjusted and tested at the factory and then folded for shipping on a road truck with minimal disassembly. The platform includes structural beams and struts that easily fold for transportation and unfold for installation in the field while the beams, struts, insulators and blade arms remain attached together. This allows for complete assembly, testing and adjustment of the switch at the factory while limiting the field assembly to simple unfolding and securing together the structural components of the switch platform.

The folding electric power switch includes a number of phase insulators (typically two for a two-way switch and three for a three-way switch), a central switch insulator, and a number of blade arms, each selectively connecting an electric power tap at the central insulator to an electric power tap at a respective phase insulator. The insulators are supported by a platform that includes one or more structural beams and one or more struts. The platform folds for transportation with the insulators, power taps, blade arms, structural beams and struts remaining attached to each other. The platform then easily unfolds for installation in the field having been previously assembled, adjusted and tested back at the factory.

More specifically, the platform may fold and unfold through pivotal articulation of the structural beams and struts. A two-way switch includes two phase insulators and a three-way switch includes three phase insulators. For the three-way switch, the platform includes a central structural beam and two lateral structural beams pivotally connected to the central beam. The central beam supports the central switch insulator and one of the phase insulators while each lateral beam supports a respective phase insulator. A first strut pivotally is connected to the central beam and removably connected to one lateral beam. Similarly, a second strut is pivotally connected to the central beam and removably connected to the second lateral beam. Each strut typically includes an upper rail and a lower rail allowing the strut to straddle its associated lateral beam when folded.

A method for reading the switch for installation includes assembling, adjusting and testing the switch at the factory. A few bolts are then removed and the switch is folded, loaded on a road truck, and transported to the installation site. The switch is unloaded in the field, unfolded and secured in the unfolded configuration through installation of the bolts. This readies the switch for installation in the with minimal field assembly, having been fully assembled, adjusted and tested back at the factory.

In view of the foregoing, it will be appreciated that the present invention provides an improved high voltage line switch and method for readying the switch for installation that minimizes field assembly while still allowing the switch to be transported by road truck. The specific structures and techniques for accomplishing the advantages described above will become apparent from the following detailed description of the embodiments and the appended drawings and claims.

DETAILED DESCRIPTION OF THE EMBODIMENTS

Figure 1:
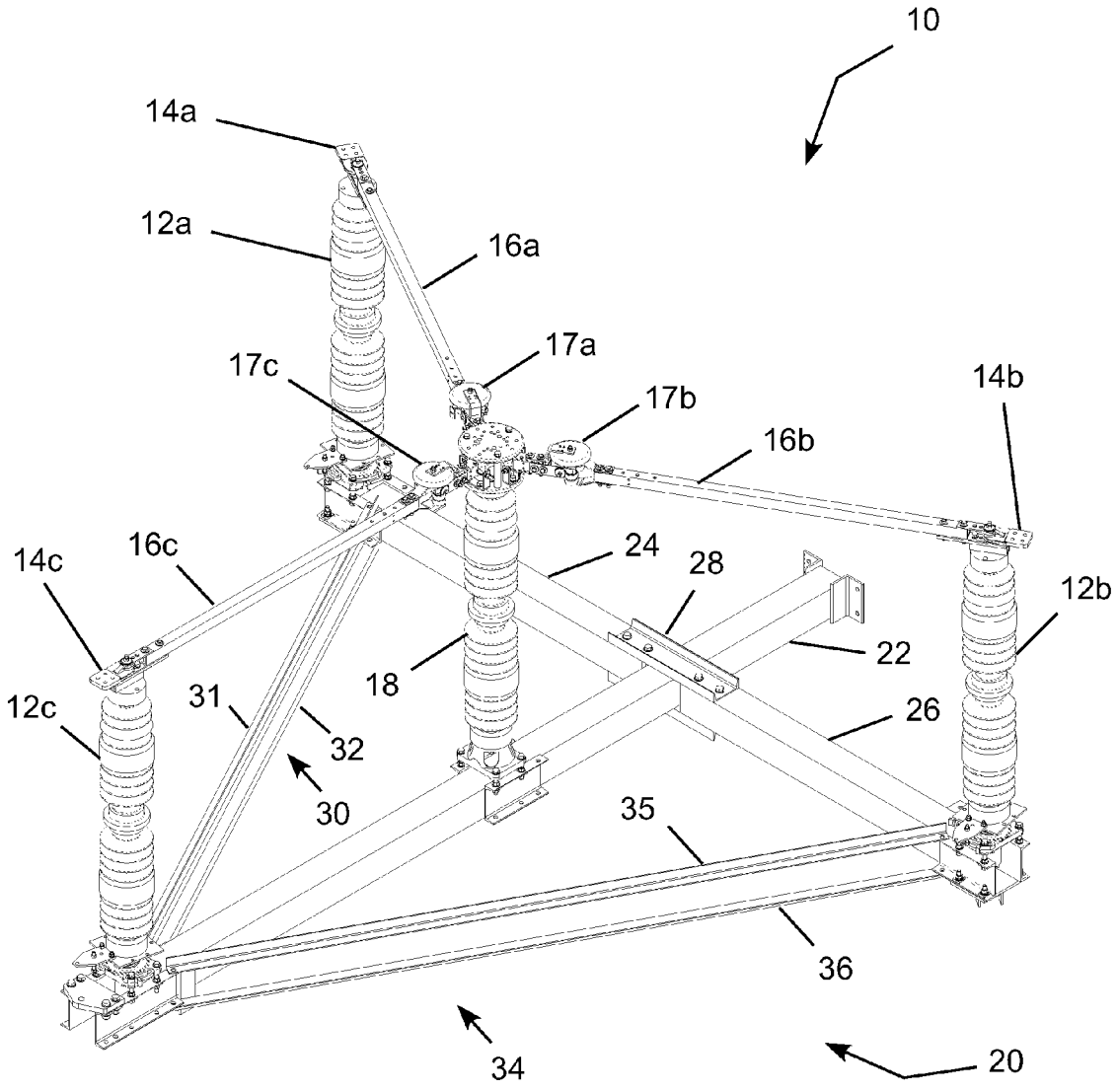
FIG. 1 is a perspective view of the folding high voltage line switch.

The present invention may be embodied in a folding high voltage electric power switch that can be fully assembled, tested and adjusted in the factory and then folded for shipping on a road truck with minimal disassembly. The platform includes structural beams and struts that easily fold for transportation and unfold for installation in the field with minimal field assembly largely limited to folding out and securing of support beams and struts.

More specifically, the foldable switch includes a number of phase insulators (e.g., two phase insulators for a 2-way switch and three phase insulators for a three-way switch), a central switch insulator and a number of blade arms, each selectively connecting an electric power tap at the central insulator to an electric power tap at a respective phase insulator. The platform that supports the insulators folds with the insulators, power taps, blade arms, structural beams and struts of the platform remaining attached to each other for transportation. This allows the platform to be unfolded and readied for installation through pivotal articulation and securing together the attached structural beams and struts.

The switch is typically configured as a two-way switch or a three-way switch. The two-way switch includes two phase insulators and a central switch insulator, while a three-way switch includes three phase insulators and the central switch insulator. Each insulator has an associated power tap for forming switched connections through the blade arms of the switch. The three-way switch therefore includes the central insulator, three phase insulators and three blade arms. The platform for the three-way switch includes a central structural beam and two lateral structural beams pivotally connected to the central beam. The central beam supports the central switch insulator and one of the phase insulators while each lateral beam supports a respective phase insulator. A first strut is pivotally connected to the central beam and removably connected to the first lateral beam. Similarly, a second strut is pivotally connected to the central beam and removably connected to the second lateral beam. Each strut typically includes an upper rail and a lower rail allowing the strut to straddle the lateral beam when folded.

The switch can be easily folded by removing the bolts connecting the struts to the lateral beams, articulating the blade arms to be substantially in line with the central beam, articulating the struts to be substantially in line with the central beam, and articulating the lateral beams to be substantially in line with the central beam. This folds the switch into a linear configuration that can be carried on a road truck. Once the switch has been delivered to this installation site, it is easily unfolded by articulating the blade arms, lateral beams and struts into place, bolting the lateral beams to a fulcrum at the central beam, and bolting the struts to the central beam. This readies the switch for installation without the need for additional assembly, adjustment or testing in the field prior to connecting the switch to the grid.

Figure 2:
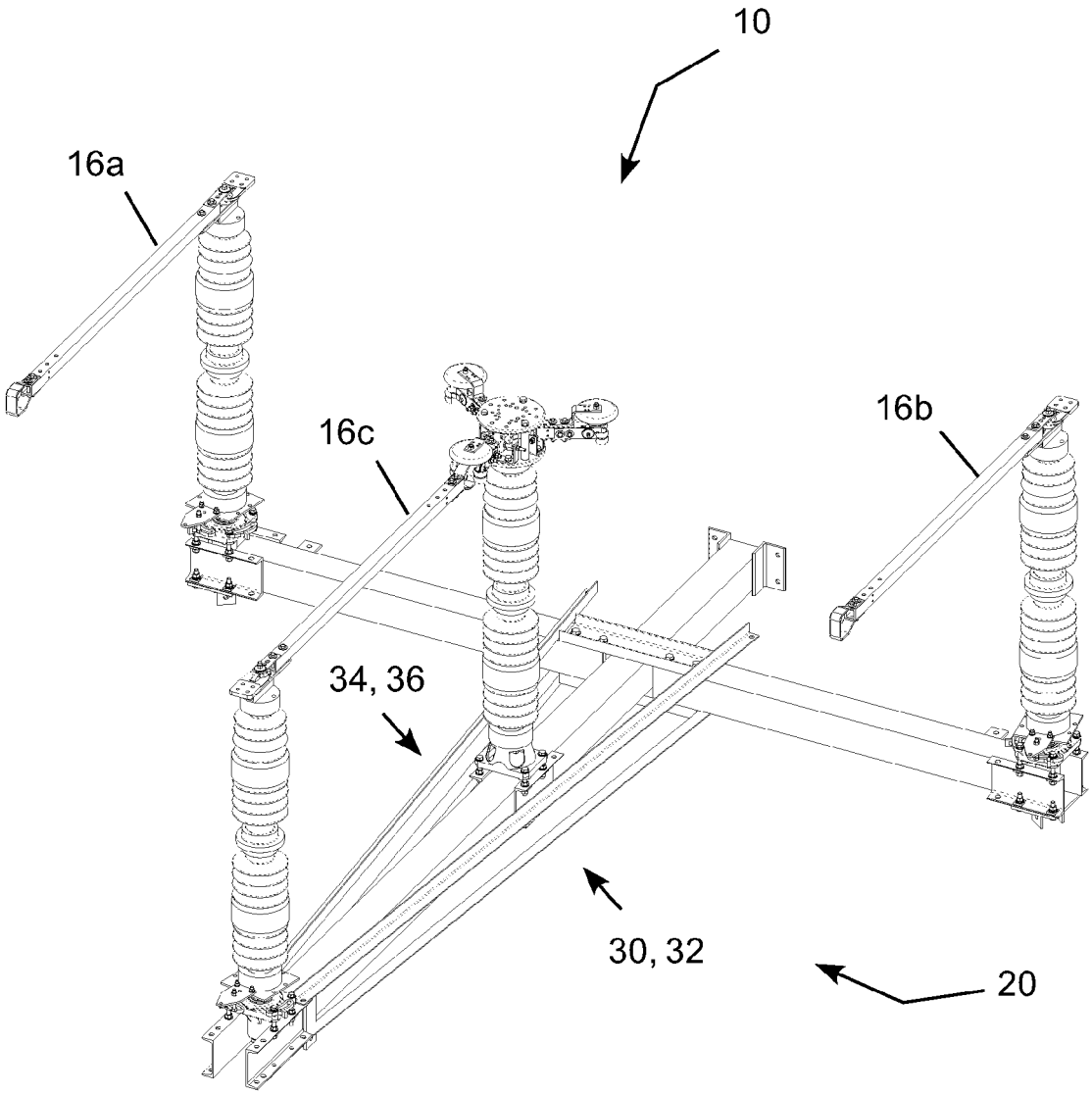
FIG. 2 is a perspective view of the folding high voltage line switch with two of the blade arms placed in position for folding the switch.
Figure 3:
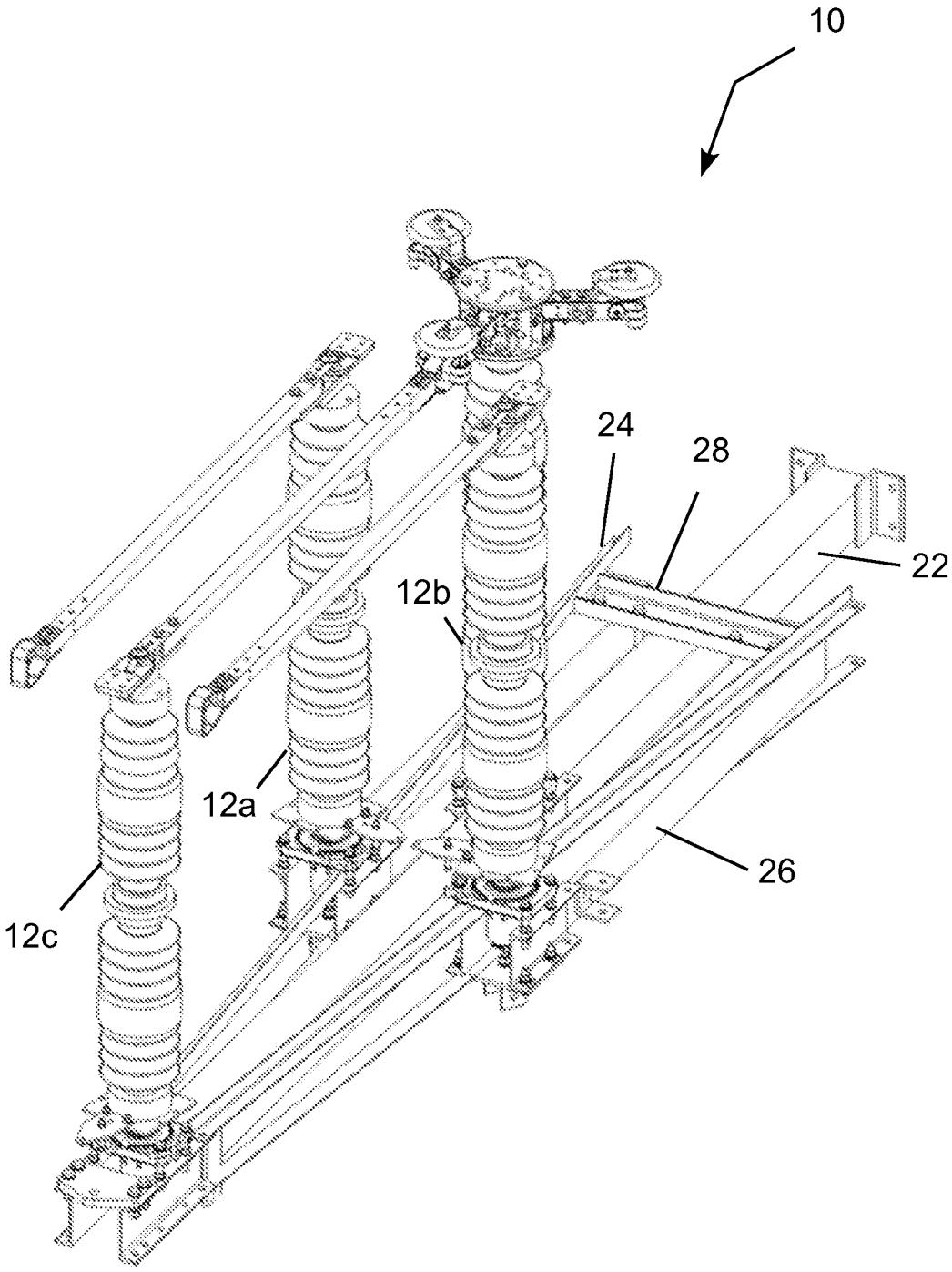
FIG. 3 is a perspective view of the folding high voltage line switch folded for transportation by road truck.
Figure 4:
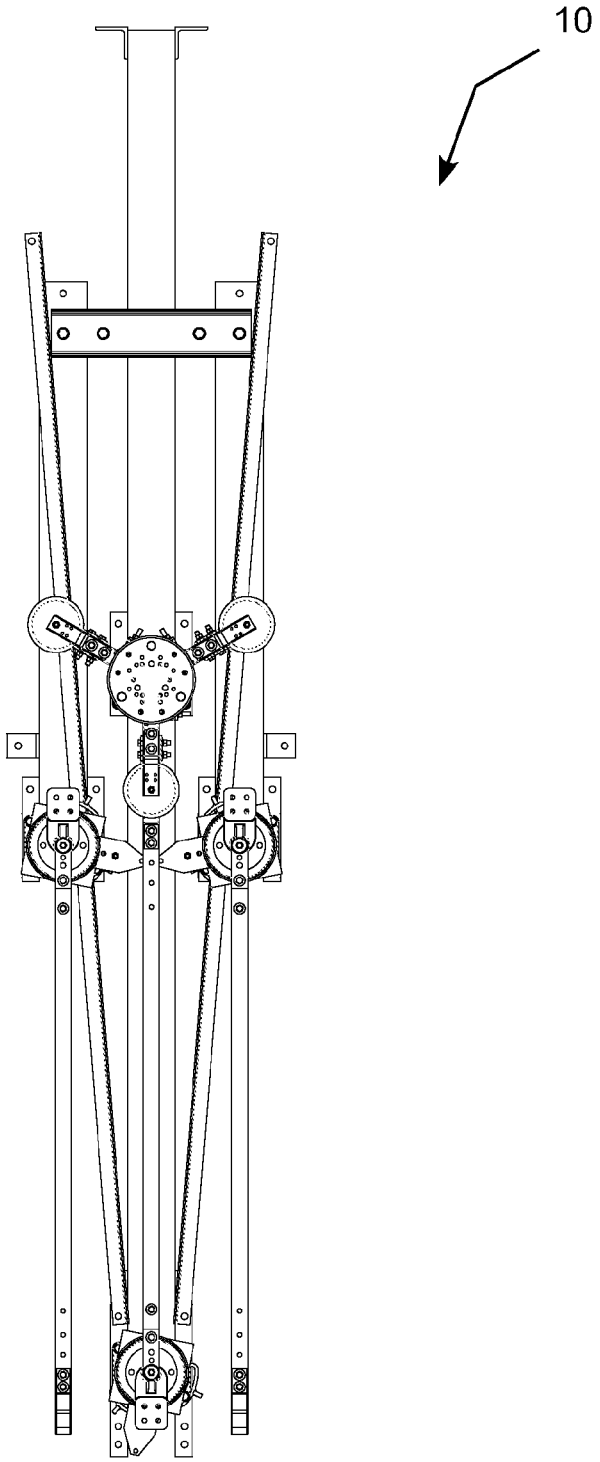
FIG. 4 is a top view of the folding high voltage line switch folded for transportation by road truck.

Turning now to the figures, FIG. 1 is a perspective view of the folding electric power switch 10, which is shown in the unfolded position ready for installation. FIG. 2 shows the switch partially folded and FIGS. 3 and 4 show the switch fully folded for transportation. The switch is fully assembled in the factory, where all of the mechanism are fully tested and adjusted. Once the switch has been fully tested and adjusted, it is folded, loaded on a road truck, and delivered to the installation location. There the switch is unloaded and unfolded to ready the switch for installation without having to adjust the switch mechanism or test the switch in the field. This is a significant advantage over conventional high voltage switch installation because it is much easier to assemble, test and adjust the switch at the factory as opposed to in the field.

In this particular example, the switch 10 includes electric switchgear forming a three-way switch supported by a folding platform 20. The electric switchgear includes three phase insulators 12*a-c*, each having an associated power tap 14*a-c* and blade arm 16*a-c*. Each blade arms selectively connects a power line connected to its associate power tap to a corresponding central power tap 17*a-c* at a central insulator 18 to selectively form switched electrical connections between the insulator power taps and central power taps. The invention may be practiced with any type of suitable switch action. For example, a manual, motor or spring driven actuator can be used to drive each blade arm from the closed position in electrical connection with its associated central power tap (to close the switch leg) to an open position in which the blade arm is not in electrical connection with the associated central power tap (to open the switch leg). In the example switch shown in the figures, the blade arms are rotated approximately 90 degrees clockwise in the horizontal plane to open the switch (i.e., side swing switch operation), although vertical switch action and different amounts of blade arm swing can be implemented if desired.

The folding platform 20 includes structural beams and struts. A central structural beam 22 supports the central insulator 18 and one of the phase insulators (phase insulator 12*c* in this example). A first lateral beam 24 supports another phase insulator (phase insulator 12*a* in this example) and a second lateral beam 26 supports the third phase insulator (phase insulator 12*b* in this example). A fulcrum 28 pivotally attaches the lateral beams to the central beam. The fulcrum allows each lateral beam to articulate between an unfolded position transverse to the central beam and a folded position in line with the central beam.

A first strut 30 is pivotally attached to the central beam 22 and removably attached to first lateral beam 24, while a second strut 34 is pivotally attached to the central beam 22 and removably attached to second lateral beam 26. This allows each strut to articulate between a diagonal unfolded position supporting an associated lateral beam in the transverse position and a folded position in line with the central beam. In addition, the first strut 30 has a split configuration including an upper rail 31 and a lower rail 32 allowing the strut to straddle the first lateral beam 24 when the strut is articulated from the unfolded position (shown in FIG. 1) to the folded position (shown in FIG. 2). Similarly, the second strut 34 includes an upper rail 35 and a lower rail 36 allowing the strut to straddle the second lateral beam 26 when the strut is articulated from the unfolded position (shown in FIG. 1) to the folded position (shown in FIG. 2).

The folding operation of the switch 10 is illustrated in the transitions from FIG. 1 to FIG. 2 and FIG. 3. FIG. 1 shows the switch in the unfolded position, in which the lateral beams 24 and 26 are transverse to the central beam 22 and held in place by the struts 30 and 34. That is, the first lateral beam 24 is held in the transverse position by the first strut 30, which extends diagonally from the distal end of the central beam to the distal end of the first lateral beam. Similarly the second lateral beam 26 is held in the transverse position by the second strut 34, which extends diagonally from the distal end of the central beam to the distal end of the second lateral beam. In this particular switch, only a few bolts are removed to allow the platform to be folded. There are two bolds fastening the fulcrum 28 to the first lateral beam 24, one bolt fastening the first strut 30 to the central beam 22 and one bolt fastening the first strut 30 to the first lateral beam 24. Similarly, there are two bolds fastening the fulcrum 28 to the second lateral beam 26, one bolt fastening the second strut 34 to the central beam 22 and one bolt fastening the second strut 34 to the second lateral beam 26.

The transition from FIG. 1 to FIG. 2 illustrates the first steps in folding the platform. The blade arms 16*a* and 16*b* are articulated from their closed positions (shown in FIG. 1) to open positions (shown in FIG. 2), in which the blade arms 16*a* and 16*b* are substantially in line with the central beam 22. The bolt securing the first strut 30 to the first lateral beam 24 is removed allowing the first strut 30 to be articulated from its unfolded position (shown in FIG. 1) to its folded position (shown in FIG. 2), in which the first strut 30 is substantially in line with the central beam 22. The split configuration of the first strut 30 into an upper rail 31 and a lower rail 32 allows the first strut to straddle the first lateral beam as it is articulated from the unfolded position to the folded position. Similarly, The bolt securing the second strut 34 to the second lateral beam 26 is removed allowing the second strut 34 to be articulated from its unfolded position (shown in FIG. 1) to its folded position (shown in FIG. 2), in which the second strut 34 is substantially in line with the central beam 22. Again, the split configuration of the second strut 34 into an upper rail 35 and a lower rail 36 allows the second strut to straddle the second lateral beam as it is articulated from the unfolded position to the folded position. This places the switch in the partially folded configuration shown in FIG. 2. It should be noted that the blade arms are not connected to their actuators at this point, which allows the blade arms to be freely rotated to the desired positions shown in FIGS. 2 and 3.

To complete the folding operation, one of the bolts fastening the first lateral beam 24 to the fulcrum 28 is removed and the first lateral beam 24 is articulated from its unfolded position (shown in FIG. 2) to its folded position (shown in FIG. 3), in which the first lateral beam 24 is substantially in line with the central beam 22. The first blade arm 16*a* may be articulated further, as necessary, until the first blade arm 16*a* is substantially in line with the central beam 22 when the first lateral beam 24 is substantially in line with the central beam 22. Similarly, one of the bolts fastening the second lateral beam 26 to the fulcrum 28 is removed and the second lateral beam 26 is articulated from its unfolded position (shown in FIG. 2) to its folded position (shown in FIG. 3), in which the second lateral beam 26 is substantially in line with the central beam 22. Again, the second blade arm 16*b* may be articulated further, as necessary, until the second blade arm 16*b* is substantially in line with the central beam 22 when the second lateral beam 26 is substantially in line with the central beam 22. This places the switch in the fully folded configuration shown in FIG. 3 allowing the switch to be loaded onto a road truck for transportation. A strap tightened around the folded platform between the phase insulators 12*a*-*b* and the fulcrum 28 will hold the switch firmly in the folded position. FIG. 4 shows the folded switch from above.

After the switch has been delivered to the installation destination, it is unloaded from the truck and unfolded through a reverse procedure, which involves minimal assembly in the field. Importantly, the switch is readied for installation with very minimal assembly largely limited to swinging the beams and struts into place and installing a few bolts without having to test to adjust the switch mechanisms in the field.

The unfolding procedure includes articulation of the first lateral beam 24 from the folded position shown in FIG. 3 to the unfolded position shown in FIG. 2. A bolt is then installed through the fulcrum 28 and the first lateral beam 24 to secure the first lateral beam 24 transverse to the central beam 22 as shown in FIG. 2. Similarly, the second lateral beam 26 is articulated from the folded position shown in FIG. 3 to the unfolded position shown in FIG. 2. A bolt is then installed through the fulcrum 28 and the second lateral beam 26 to secure the second lateral beam 26 transverse to the central beam 22 as shown in FIG. 2. The first strut 30 is articulated from the folded position shown in FIG. 2 to the unfolded position shown in FIG. 1. A bolt is then installed through the first strut 30 and the first lateral beam 24 to secure the first lateral beam in the transverse position shown in FIG. 1. Similarly, the second strut 34 is articulated from the folded position shown in FIG. 2 to the unfolded position shown in FIG. 1. A bolt is then installed through the second strut 34 and the second lateral beam 26 to secure the second lateral beam in the transverse position shown in FIG. 1. The blade arms 16*a* and 16*b* are then articulated from their folded positions shown in FIG. 3 to their unfolded positions shown in FIG. 1 to ready the switch for installation.

Figure 5:
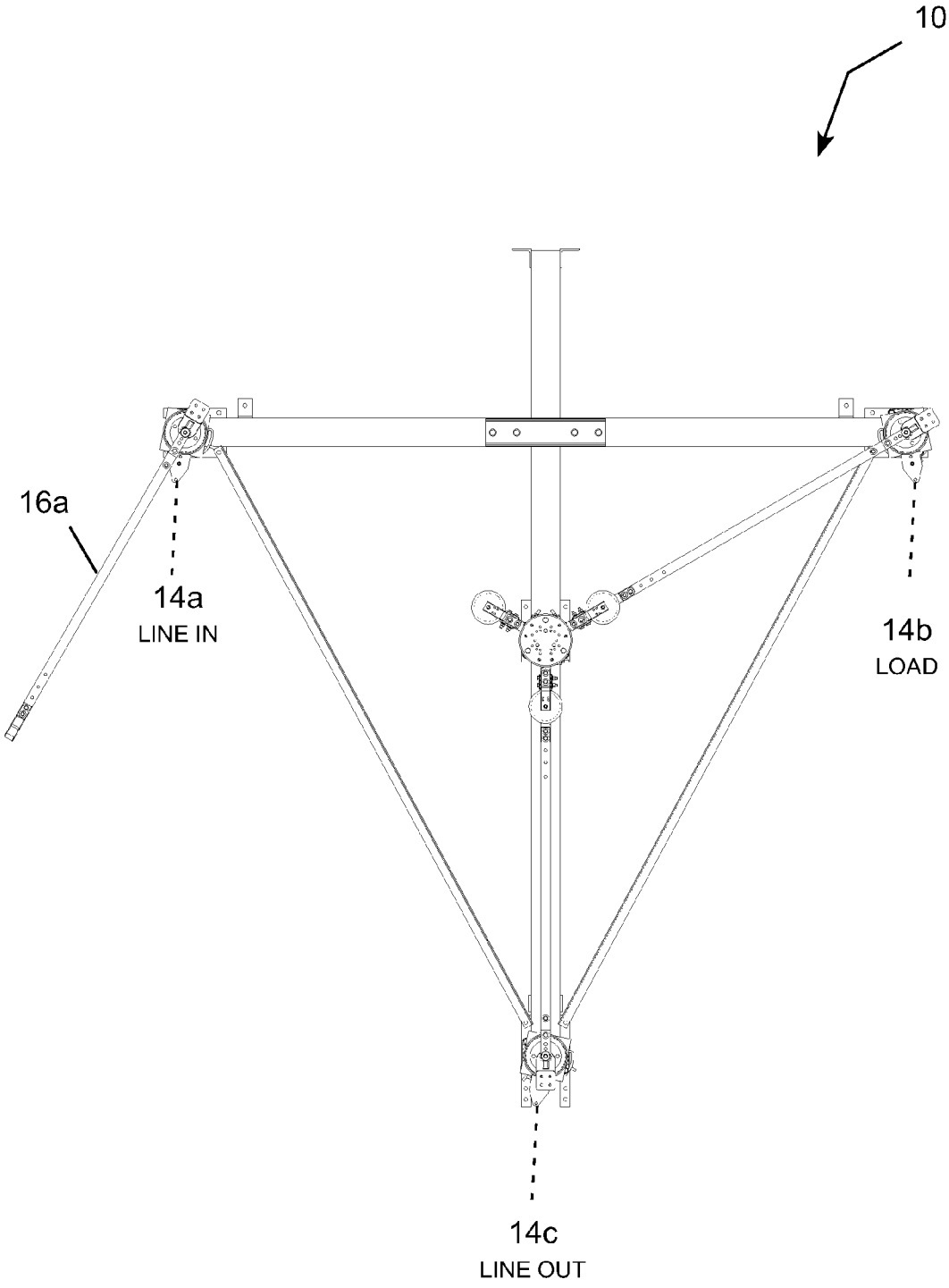
FIG. 5 is a top view of the folding high voltage line switch with the blade arm for a first phase shown in the open position.
Figure 6:
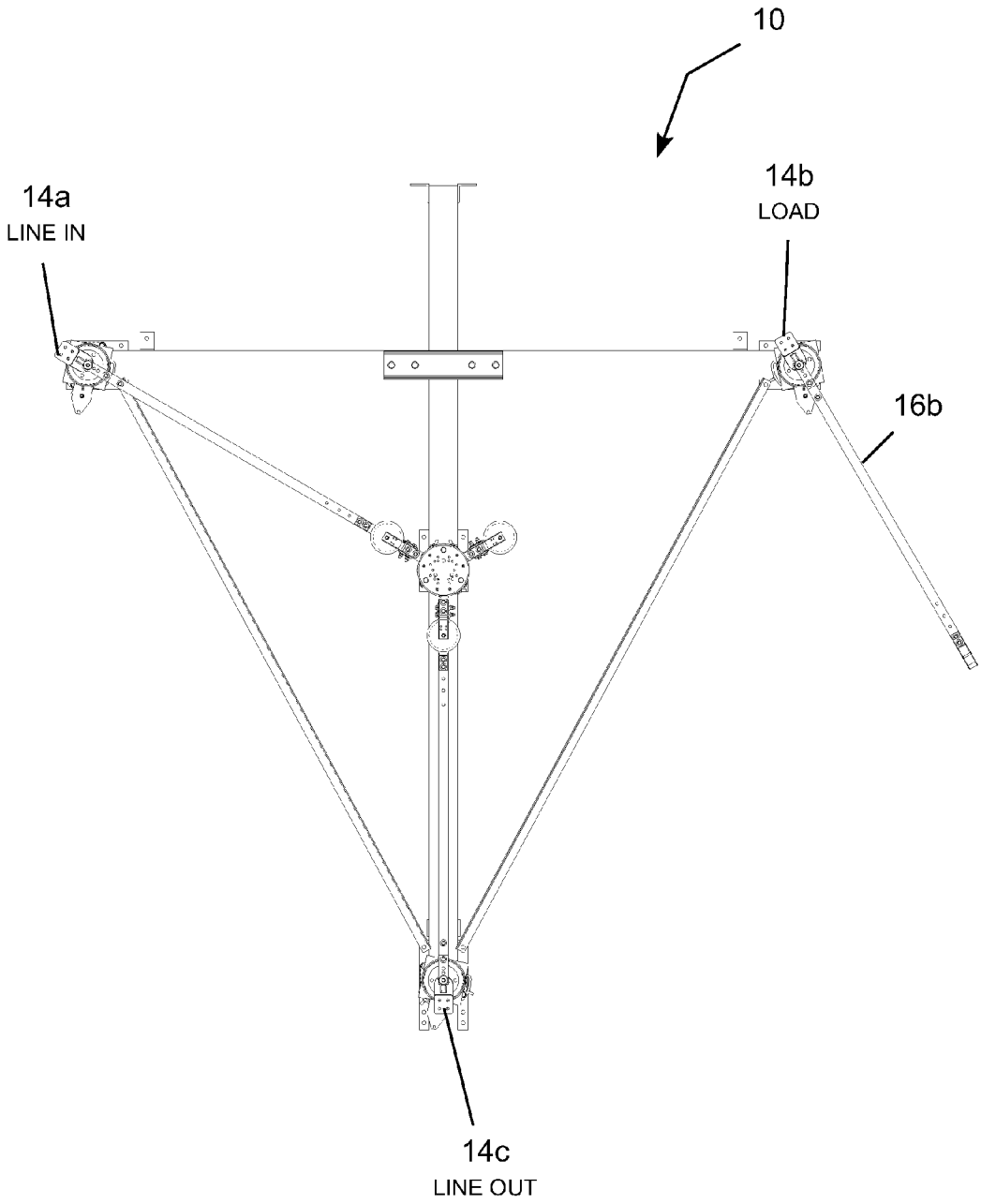
FIG. 6 is a top view of the folding high voltage line switch with the blade arm for a second phase shown in the open position.
Figure 7:
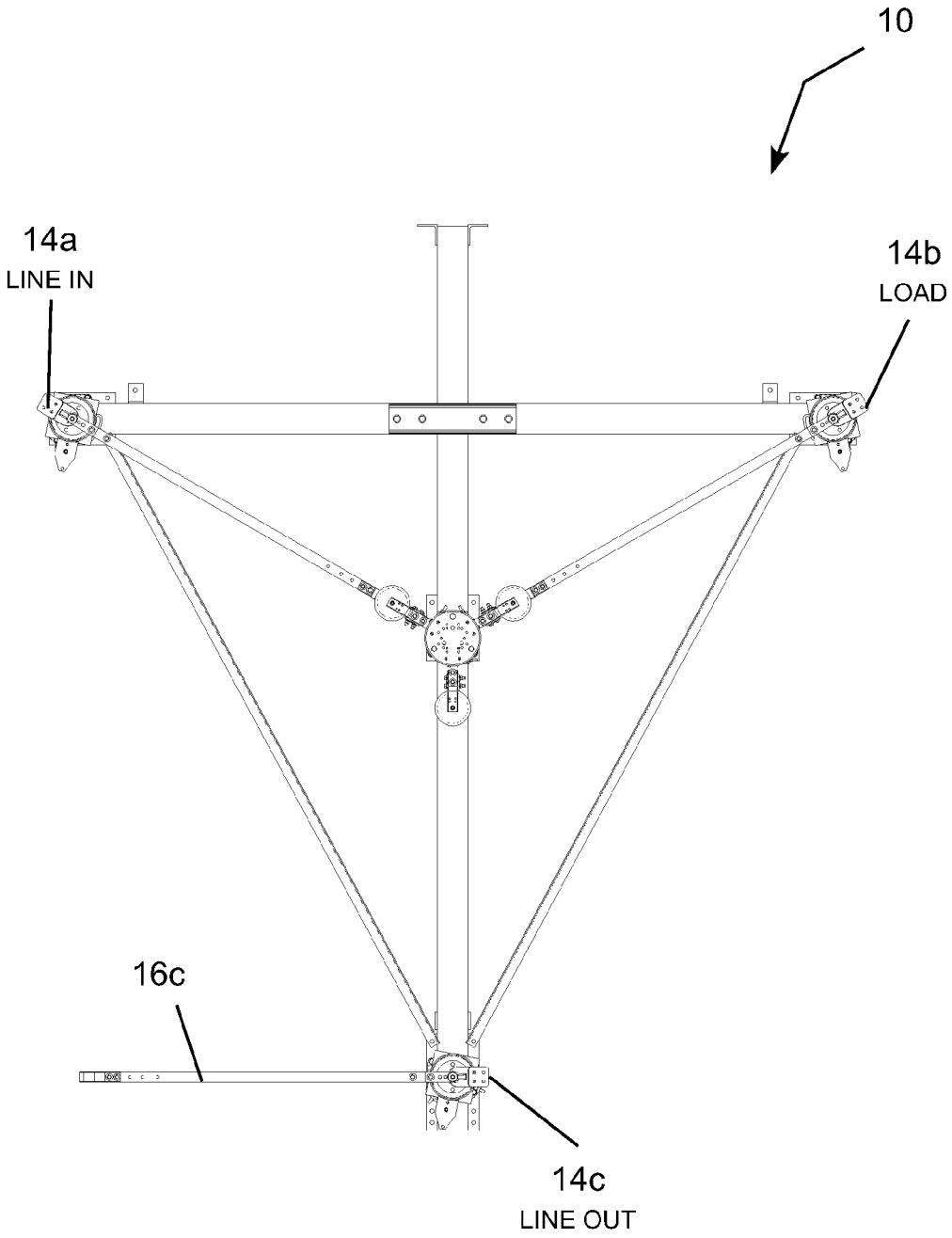
FIG. 7 is a top view of the folding high voltage line switch with the blade arm for a third phase shown in the open position.

FIGS. 5-7 illustrate operation of the switch 10. For this illustration, the power "line in" is shown attached to the first power tap 14*a*, the load is shown attached to the second power tap 14*b*, and the "line out" is shown attached to the third power tap 14*c*. FIG. 5 shows the switch 10 with the first blade arm 16*a* open, which disconnects the line in from the load and the line out. This switch operation is useful for isolating the load and the line out from the line in, for example when the line in experiences a short or maintenance outage. FIG. 6 shows the switch 10 with the second blade arm 16*b* open, which disconnects the load from the line in and the line out. This switch operation is useful for disconnecting the load while keeping the line in connected to the line out to bypass the load. This switch operation is useful for isolating the load from the line, for example when the load experiences a short or maintenance outage. FIG. 7 shows the switch 10 with the third blade arm 16*c* open, which disconnects the line out from the load and the line in. This switch operation is useful for isolating the load from the line out, for example when the line out experiences a short or maintenance outage.

Those skilled in the art will appreciate that additional bolts or different types of fasteners may be used in the switch. It will also be apparent how to configure a two-way switch using the similar techniques. It will be further understood that the foregoing describes a preferred embodiment of the invention and that many adjustments and alterations will be apparent to those skilled in the art within the spirit and scope of the invention as defined by the appended claims.

The invention claimed is:

1. A foldable high voltage electric power switch, comprising:

a plurality of phase insulators, each having an associated power tap;

a central switch insulator having a plurality of power taps, each corresponding to a respective phase insulator;

a plurality of blade arms, each selectively connecting a respective electric power tap at the central insulator to the electric power tap at a respective phase insulator;

a platform comprising one or more structural beams and one or more struts supporting the insulators;

wherein the platform is configured to fold for transportation with the insulators, power taps, blade arms, structural beams and struts remaining attached to each other; and wherein the platform is configured to unfold to ready the switch for installation.

2. The switch of claim 1, wherein:

the platform is configured to fold for transportation through pivotal articulation of one or more structural beams and one or more struts; and the platform is configured to unfold through pivotal articulation of the one or more structural beams and the one or more struts.

3. The switch of claim 2, wherein the plurality of phase insulators includes three insulators, and the plurality of blade arms includes three blade arms.

4. The switch of claim 3, wherein the structural beams include a central structural beam and two lateral structural beams pivotally connected to the central beam.

5. The switch of claim 4, wherein the central beam supports the central switch insulator and one of the phase insulators and each lateral beam supports a respective phase insulator.

6. The switch of claim 5, wherein the struts include:

a first strut pivotally connected to the central beam and removably connecting the central beam to a first of the lateral beams; and a second strut pivotally connected to the central beam and removably connecting the central beam to a second of the lateral beams.

7. The switch of claim 6, wherein the first and second struts each comprise an upper rail and a lower rail allowing the strut to straddle an associated lateral beam when folded to a position substantially in line with the central beam.

8. A foldable high voltage electric power switch, comprising:

three phase insulators and a central switch insulator;

three of blade arms, each selectively connecting a respective electric power tap at the central insulator to an electric power tap at a respective phase insulator;

a platform supporting the insulators;

wherein the platform includes a first lateral beam supporting a first phase insulator, a second lateral beam supporting a second phase insulator, and a central beam supporting the central switch insulator and a third phase insulator;

wherein the first and second lateral beams are pivotally connected to the central beam;

wherein the platform further includes a first and second struts pivotally connected to the central beam, each removably connected to a respective lateral beam;

wherein the platform is configured for folding for transportation through pivotal articulation of the lateral beams and struts with the insulators, power taps, blade arms, structural beams and struts remaining attached to each other; and wherein the platform is configured for unfolding and readying for installation through pivotal articulation of the lateral beams and struts and securing of the struts beams to the lateral beams.

9. The switch of claim 8, wherein the plurality of phase insulators includes three insulators, and the plurality of blade arms includes three blade arms.

10. The switch of claim 8, wherein the first and second struts each comprise an upper rail and a lower rail allowing the strut to straddle an associated lateral beam when folded to a position substantially in line with the central beam.

11. A method for readying a foldable high voltage electric power switch for installation, comprising:

providing a switch including a plurality of phase insulators, a central switch insulator, a plurality of blade arms, each blade arm selectively connecting a respective electric power tap at the central insulator to an electric power tap at a respective phase insulator, and a platform comprising one or more structural beams and one or more struts supporting the insulators;

testing and adjusting switch mechanism with the switch in an unfolded configuration;

folding the platform with the insulators, power taps, blade arms, structural beams and struts of the platform remaining attached to each other for transportation;

loading the switch on a road truck and transporting the folded switch to an installation location;

unloading the switch at an installation location; and unfolding the switch through pivotal articulation and securing of the attached structural beams and struts to ready the switch for installation.

12. The method of claim 11, wherein:

the step of folding the platform comprises pivotal articulation of the structural beams and struts; and the step of unfolding the platform comprises pivotal articulation of the structural beams and struts and securing of the structural beams to the struts.

13. The method of claim 11, wherein the platform includes first and second lateral beams pivotally connected to a central beam and first and second struts pivotally connected to the central beam, and wherein the step of unfolding the switch further comprises the steps of:

articulating the first lateral beam from a position substantially in line with the central beam to a position substantially transverse to the central beam;

articulating the second lateral beam from a position substantially in line with the central beam to a position substantially transverse to the central beam;

articulating the first strut from a position substantially in line with the central beam to a position interconnecting with the first lateral beam positioned transverse to the central beam;

articulating the second strut from a position substantially in line with the central beam to a position interconnecting with the second lateral beam positioned transverse to the central beam;

securing the first strut to the first transverse beam; and securing the second strut to the second transverse beam.

14. The method of claim 12, wherein the step of folding the platform further comprises the step of articulating one or more blade arms from a position substantially in line with the central beam to a position interconnecting with a corresponding central power tap at the central switch insulator.

15. The method of claim 11, wherein the platform includes first and second lateral beams pivotally connected to a central beam and first and second struts pivotally connected to the central beam, and wherein the step of folding the switch further comprises the steps of:

detaching the first strut from the first transverse beam;

detaching the second strut from the second transverse beam;

articulating the first lateral beam to a position substantially in line with the central beam;

articulating the second lateral beam to a position substantially in line with the central beam;

articulating the first strut to a position substantially in line with the central beam; and articulating the second strut to a position substantially in line with the central beam.

16. The method of claim 15, wherein the step of folding the switch further comprises the step of articulating one or more blade arms to a position substantially in line with the central beam.

17. The method of claim 15, wherein the first and second struts each comprise an upper rail and a lower rail allowing the strut to straddle an associated lateral beam when folded to a position substantially in line with the central beam.

18. The method of claim 15, wherein the step of unfolding the switch further comprises the steps of:

articulating the first lateral beam from the position substantially in line with the central beam to the position substantially transverse to the central beam;

articulating the second lateral beam from the position substantially in line with the central beam to the position substantially transverse to the central beam;

articulating the first strut from the position substantially in line with the central beam to the position interconnecting with the first lateral beam positioned transverse to the central beam;

articulating the second strut from the position substantially in line with the central beam to the position interconnecting with the second lateral beam positioned transverse to the central beam;

securing the first strut to the first transverse beam; and securing the second strut to the second transverse beam.

* * * * *